United States Patent [19]

Lang et al.

[11] 4,426,022

[45] Jan. 17, 1984

[54] DEVICE FOR DISPENSING A SINGLE-COMPONENT OR MULTI-COMPONENT SUBSTANCE

[75] Inventors: Gusztav Lang; Achim Hirsemann, both of Munich, Fed. Rep. of Germany

[73] Assignee: Hilti Aktiengesellschaft, Schaan, Liechtenstein

[21] Appl. No.: 293,943

[22] Filed: Aug. 18, 1981

[30] Foreign Application Priority Data

Aug. 25, 1980 [DE] Fed. Rep. of Germany ..... 3031938

[51] Int. Cl.[3] ..... B67D 5/60; B67D 5/42

[52] U.S. Cl. ..... 222/130; 222/327; 222/389

[58] Field of Search ..... 222/130, 323, 324, 325, 222/326, 327, 334, 386, 387, 389, 399, 129

[56] References Cited

U.S. PATENT DOCUMENTS

| | | | |
|---|---|---|---|
| 2,818,999 | 1/1958 | Miller | 222/323 |
| 3,568,892 | 3/1971 | Burk | 222/327 |
| 4,165,022 | 8/1979 | Bentley et al. | 222/325 |

FOREIGN PATENT DOCUMENTS

| | | |
|---|---|---|
| 1782562 | 7/1959 | Fed. Rep. of Germany . |
| 1452414 | 10/1976 | United Kingdom . |

*Primary Examiner*—Joseph J. Rolla
*Assistant Examiner*—Michael S. Huppert
*Attorney, Agent, or Firm*—Toren, McGeady and Stanger

[57] ABSTRACT

A device for dispensing measured amounts of a single-component or multi-component substance, such as an adhesive material, a sealing material or a filler material, includes a container holding the substance. A cartridge of propellant gas is positioned within the container and is arranged to supply the propellant gas into contact with a piston which is displaceable in the container for dispensing the substance.

8 Claims, 3 Drawing Figures

DEVICE FOR DISPENSING A SINGLE-COMPONENT OR MULTI-COMPONENT SUBSTANCE

SUMMARY OF THE INVENTION

The present invention is directed to a device for the measured output of a single-component or multi-component substance, such as an adhesive material, a sealing material or a filler material, with the substance held within a container in which a displaceable piston presses the substance out of the container. A gaseous propellant is directed against the piston for moving it through the container and thereby dispensing the substance.

The substances as mentioned above are usually very viscous and, as a result, require a considerable pressing force to dispense them. It is usually not acceptable to apply such a force for a long period. It has been suggested in the past to force the substance out of the container with the aid of a pressurized medium. Such a pressurized medium could be compressed air or water. Whichever medium is used, it is necessary to provide a supply system. In the past the disadvatage has been that the supply system must be connected to the dispensing device by means of a hose. Such a hose connection limits the freedom of movement of the device. Another disadvantage of such an arrangement is that the hose may be damaged.

Therefore, it is the primary object of the present invention to provide a device for dispensing single-component or multi-component substances which is not dependent on a separate supply system.

In accordance with the present invention, the substance is forced out of the container by using a replaceable cartridge containing a gaseous propellant. The cartridge may hold compressed air, carbon dioxide or some other propellant. The size of the cartridge can be selected so that the contents of the cartridge is sufficient to dispense several times the contents of the container of a single-component or multi-component substance.

Because of manufacturing techniques, it is advantageous if the cartridge is located in a section of the container separate from the substance to be dispensed. In such an arrangement, the amount of propellant can be best adjusted to the amount of substance to be dispensed. Using such an arrangement, the container and the cartridge form one unit and can be replaced in the same operation. In one embodiment, the cartridge can be arranged in the center of the container. When a multi-component substance is used, the container is divided by longitudinal partition walls into separate compartments each holding one of the substance components. The propellant is to be released in measured quantities. Accordingly, it is advantageous if the cartridge has an outlet valve for the gaseous propellant. The outlet valve can be in the form of a ball seat valve. A ball seat valve is of a particularly simple construction and is distinguished by a high operating reliability.

The outlet valve must be opened to release the propellant for dispensing the substance. Therefore, it is advantageous to provide a control mechanism for the outlet valve. The control mechanism can be triggered mechanically or by a lever system.

The substance in the container is to be selectively dispensed. To prevent leakage of the substance when the dispensing device is not in use, it is advantageous if the working space admitting the propellant to the piston has a pressure relief valve. When the dispensing device is not in use, the pressure relief valve discharges the propellant from the working space communicating with the piston.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figures 1, 2:
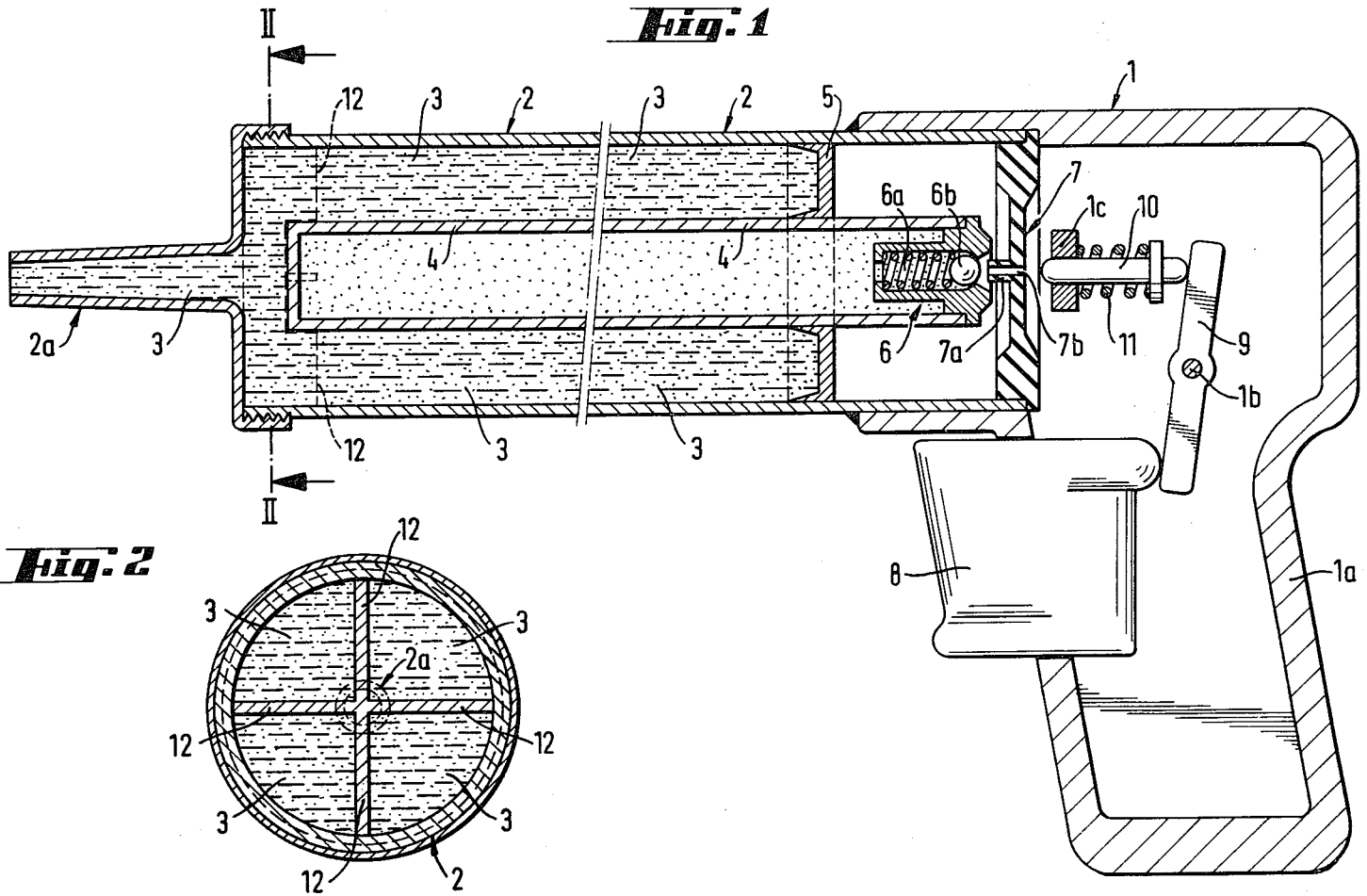
FIG. 1 is a cross-sectional side view of a device embodying the present invention with the device in the at-rest condition.
FIG. 2 is a sectional view taken along the line II—II of FIG. 1.

As shown in FIG. 1 the device for dispensing a single-component or a multi-component substance includes a casing 1. A handle l*a* forms a part of and extends outwardly from one side of the casing 1. A container 2 is fitted into an opening in the casing 1 and projects outwardly from the casing. The container holds a single-component or a multi-component substance 3. The container 2 is an elongated member having a first or front end spaced outwardly from the casing 1 and a second or rear end located within the casing. An outlet nozzle 2*a* is located on the front end of the container 2. A cartridge 4 is located centrally within the container and extends from the rear end within the casing to adjacent the output nozzle 2*a*. Cartridge 4 contains a gaseous propellant which provides the driving force for dispensing the substance 3 out of the container 2. The cartridge 4 is enclosed at its front end and along its sides by the substance 3. Encircling the cartridge 4 and extending transversely of the direction between the front end and the rear end of the cartridge is a piston or plunger 5 forming a rear end closure for that portion of the container 2 in which the substance 3 is held. At its rear end, the cartridge 4 has an outlet valve 6. Outlet vlave 6 includes a spring 6*a* and a ball 6*b*. The valve housing forms a valve seat against which the ball is held by the spring in the closed position of the valve. As illustrated in FIG. 1, the cartridge 4 is in the closed condition. At its rear end, the container 2 is closed by a disc-like elastic closure 7. Closure 7 has a projection 7*a* extending into the container for actuating the outlet valve 6. In addition, the closure 7 includes a pressure relief valve 7*b*. In the arrangement as illustrated in FIG. 1, any pressure in the space between the plunger or piston 5 and the closure 7 is released by the pressure relief valve 7*b*. Therefore, the substance 3 held within the container 2 is not pressurized with the device in the condition shown in FIG. 1. A control mechanism for the outlet valve 6 is located within the casing 1. This control mechanism includes a trigger 8 located in the handle 1*a* and a lever pivotally mounted on an axle 1*b* with one end of the lever in contact with the trigger and the other end in contact with a pin 10 which is axially slidable in a guidance 1c located within the casing 1. Pin 10 and along with it the lever 9 and the trigger 8 are held in the position illustrated in FIG. 1 by a compression spring 11 extending between the guidance 1c and a flange-like part on the pin 10. Cartridge 4 is supported in the longitudinal direction of the container by longitudinally extending ribs 12. These ribs 12 center the cartridge 4 within the container 2. If the contents of the container 2 is a multi-component substance, then the ribs 12 form separating partitions which extend over the entire length of the container. Further, the plunger is similarly subdivided into individual sectors for pressing the individual components into the nozzle 2a.

As displayed in FIG. 2 the ribs 12 are disposed in a cross-like construction. This arrangement provides for the centering of the cartridge 4 in the front end of the container 2. The ribs 12 can be formed as a separate part or they can be integrally connected to the container 2 or to the cartridge 4.

Figure 3:
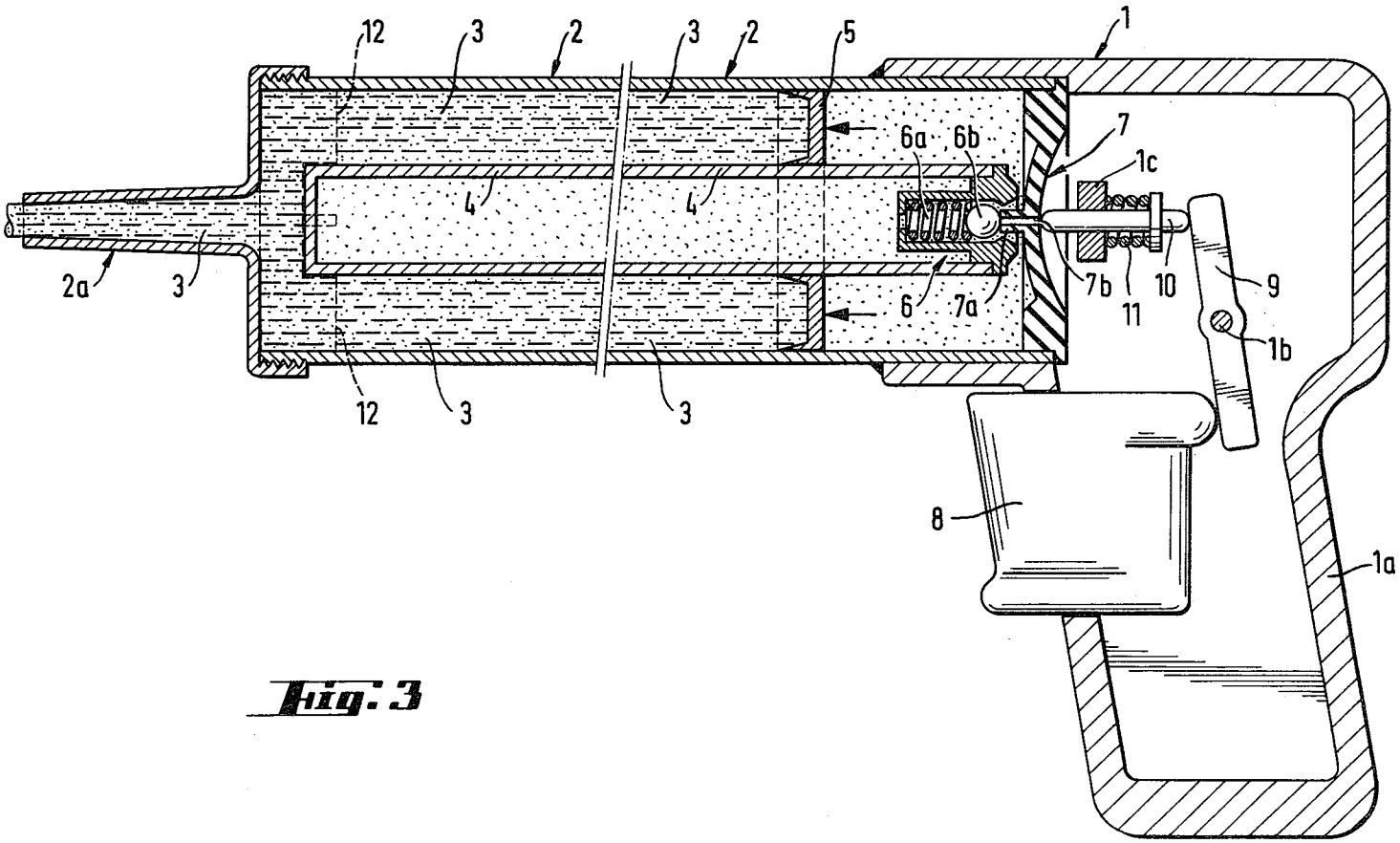
FIG. 3 is a cross-sectional view similar to that in FIG. 1, however, showing the propellant substance being discharged for dispensing the substance from the container.

When the trigger is actuated, that is when it is pressed into the handle 1b, the parts of the control mechanism assume the position shown in FIG. 3. By pressing the trigger 8 inwardly, the lever 9 is pivoted, as viewed in FIG. 3, counterclockwise about the axle 1b. This movement of the lever 9 pushes the pin 10 against the biasing force of the compression spring 11 toward the outlet valve 6. The forward movement of the pin 10 causes it to close the pressure relief valve 7b in the closure 7 of the container 2. Contact between the front end of the pin 10 and the closure 7, deforms the closure so that it assumes a curved configuration displaced toward the outlet valve 6. Projection 7a on the side of the closure facing into the container is then pressed against the ball 6b and moves it against the force of the spring 6a away from the closed position shown in FIG. 1 to the opened position shown in FIG. 3. This displacement of the ball 6b places the outlet valve 6 in the open condition. A part of the gaseous propellant within the cartridge 4 then flows into the space between the closure 7 and the piston 5 resulting in a pressure build-up. Due to this pressure build-up acting on the piston 5, a part of the substance 3 within the container 2 is displaced and flows into the nozzle 2a from which it is dispensed. When the trigger 8 is released, the contact between the pin 10 and the closure 7 is discontinued due to the biasing action of the spring 11 and the closure 7 returns to the position shown in FIG. 1. As the closure 7 flexes rearwardly the projection 7a away from the ball 6b and the outlet valve 6 returns to the closed position. The pressure build-up within the space between the closure 7 and the piston 5 is released through the pressure relief valve 7b, since the pin 10 no longer closes the rear end of the relief valve. Consequently, when the device is not in use, when it is not dispensing the substance, the space between the piston 5 and the closure 7 is not pressurized. When the trigger is not pressed inwardly into the handle l*a*, the compression spring 11 returns the pin 10, the lever 9 and the trigger 8 into the at-rest condition shown in FIG. 1.

The cartridge 4 may contain the propellant within it, however, it is also possible to provide the propellant in a separate exchangeable propellant cartridge.

While specific embodiments of the invention have been shown and described in detail to illustrate the application of the inventive principles, it will be understood that the invention may be embodied otherwise without departing from such principles.

We claim:

1. Device for dispensing measured amounts of a single-component or multi-component substance, such as an adhesive material, a sealing material or a filler material, comprising a container for the substance to be dispensed, said container is elongated having a first end from which the substance is dispensed and a second end, a piston located within said container and extending transversely of the first end-second end direction, said piston is displaceable in the first end-second end direction toward the first end for dispensing the substance out of said container, means for introducing a pressurized propellant into contact with the piston for displacing said piston toward the first end of said container, said means comprising a replaceable cartridge of a gaseous propellant, said cartridge is located within said container and is separated from the part of said container holding the substance to be dispensed, said cartridge includes an outlet valve for discharging the gaseous propellant out of said cartridge, said container and said cartridge therein in combination with said piston forming a space between said piston and the second end of said container for receiving the gaseous propellant from said outlet valve so that the gaseous propellant acts on said piston for displacing said piston toward the first end of said container, a casing for holding the second end of said container, a flexible elastic member forming a closure across the second end of said container, means mounted within said casing for displacing said closure inwardly into said container for opening said outlet valve.

2. Device, as set forth in claim 1, wherein said closure includes a pressure relief valve for releasing gaseous propellant from the space between said plunger and said closure.

3. Device for dispensing measured amounts of a single-component or multi-component substance, such as an adhesive material, a sealing material or a filler material, comprising a casing, a container for the substance to be dispensed, said container is elongated having a first end from which the substance is dispensed and a second end, the second end of said container being positioned within said casing and the first end of said container located outwardly from said casing, a pressurized propellant cartridge located within said container and extending in the first end-second end direction thereof with the one end of said cartridge being located within and adjacent the second end of said container, a piston located within said container and being displaceable therein in the first end-second end direction toward the first end for dispensing the substance out of said container, said piston in combination with said container and said cartridge forming a space located between said piston and the second end of said container for receiving the pressurized propellant from said cartridge for displacing said piston toward the first end of said container, said cartridge having an outlet valve in the end thereof adjacent the second end of said container, a flexible closure extending across the second end of said container and being flexibly displaceable inwardly into said container toward the one end of said cartridge, and means within said casing for displacing said closure inwardly into said container into engangement with said outlet valve for opening said outlet valve and supplying the pressurized propellant into the space between said piston and the second end of said container.

4. Device, as set forth in claim 3, wherein said closure has a projection extending into said container with a bore through said closure and projection opening into the space within said container between said piston and the second end of said container, and said bore providing a pressure relief valve for releasing the pressurized propellant contained within said space.

5. Device, as set forth in claim 4, wherein said means includes a pin-like member mounted within said casing exteriorly of and adjacent the second end of said container, said pin-like member being movably displaceably into contact with said closure for closing the bore through said closure and projection for effecting a closing of the pressure relief valve formed by said bore.

6. Device, as set forthh in claim 5, including a trigger mounted within said casing, a lever pivotally mounted within said casing and having one end thereof in contact with said trigger and the other end thereof in contact with said pin-like member so that by pressing said trigger against said lever said lever displaces said pin-like member.

7. Device, as set forth in claim 3, wherein said cartridge is centrally positioned within said container extending from adjacent the second end thereof to adjacent the first end thereof, said piston is an annular member encircling said cartridge with the radially inner periphery of said piston encircling and in contact with said cartridge and the radially outer periphery of said piston in contact with the inside surface of said container.

8. Device, as set forth in claim 7, wherein rib-like walls located adjacent the first end of said container and extending radially inwardly from the inside surface of said container into contact with the outside surface of said cartridge for centering said cartridge within said container.

* * * * *